United States Patent [19]

Vogt et al.

[11] Patent Number: 4,919,845

[45] Date of Patent: Apr. 24, 1990

[54] PHOSPHATE-FREE DETERGENT HAVING A REDUCED TENDENCY TOWARDS INCRUSTATION

[75] Inventors: Guenther Vogt, Toenisvorst; Hans Andree, Leichlingen; Gertrud Nienhaus, Duesseldorf, all of Fed. Rep. of Germany

[73] Assignee: Henkel Kommanditgesellschaft auf Aktien, Duesseldorf, Fed. Rep. of Germany

[21] Appl. No.: 378,447

[22] Filed: Jul. 7, 1989

Related U.S. Application Data

[63] Continuation of Ser. No. 195,996, May 19, 1988, abandoned.

[30] Foreign Application Priority Data

May 21, 1987 [DE] Fed. Rep. of Germany ..... 3717227

[51] Int. Cl.[5] ..... C11D 3/08; C11D 3/12; C11D 3/30; C11D 3/36

[52] U.S. Cl. ..... 252/526; 252/109; 252/110; 252/131; 252/135; 252/140; 252/155; 252/174.14; 252/174.16; 252/174.24; 252/174.25; 252/179; 252/180; 252/539; 252/540; 252/DIG. 11; 252/DIG. 17

[58] Field of Search ..... 252/109, 110, 131, 135, 252/140, 155, 174.14, 174.16, 174.24, 174.25, 179, 180, 539, 540, 526, DIG. 11, DIG. 17

[56] References Cited

U.S. PATENT DOCUMENTS

| | | | |
|---|---|---|---|
| 3,723,333 | 3/1973 | Freyhold | 252/175 |
| 3,870,522 | 3/1975 | Moisar et al. | 96/107 |
| 3,959,167 | 5/1976 | Hwa | 252/180 |
| 3,959,168 | 5/1976 | Germsheid | 252/180 |
| 3,966,629 | 6/1976 | Dumbrell | 252/140 |
| 4,144,226 | 3/1979 | Crutchfield et al. | 528/231 |
| 4,146,495 | 3/1979 | Crutchfield et al. | 252/89 |
| 4,179,391 | 12/1979 | Kaufmann | 252/99 |
| 4,265,777 | 5/1981 | Boyer | 252/113 |
| 4,652,403 | 3/1987 | May | 252/526 |
| 4,707,290 | 11/1987 | Seiter | 252/140 |
| 4,737,306 | 4/1988 | Wichelhaus | 252/95 |

FOREIGN PATENT DOCUMENTS

| | | | |
|---|---|---|---|
| 026529 | 8/1981 | European Pat. Off. . | |
| 0124913 | 11/1984 | European Pat. Off. | 252/174.24 |
| 3526405 | 5/1987 | Fed. Rep. of Germany . | |
| 2097419A | 11/1982 | United Kingdom . | |

*Primary Examiner*—Dennis Albrecht

*Attorney, Agent, or Firm*—Ernest G. Szoke; Wayne C. Jaeschke; Real J. Grandmaison

[57] ABSTRACT

A detergent composition containing by weight (a) from 5 to 35% of an anionic or nonionic surfactant, (b) from 10 to 40% of finely crystalline zeolite, (c) from 4 to 20% of alkali metal silicate or carbonate and from 0.1 to 5% of (d) aminoalkanephosphonate or (d2) copolymer of (meth)acrylic acid and maleic acid and (e) from 5 to 80% of other detergent constituents is considerably improved in regard to its incrustation-inhibiting properties if it additionally contains (f) from 0.05 to 1% (based on the free acid) of 1-hydroxyethane-1,1-diphosphonic acid in the form of its alkali metal salt. The weight ratio of (d1) to (f) is from 3:1 to 1:6 and of (d2) to (f) is from 40:1 to 2:1.

10 Claims, No Drawings

PHOSPHATE-FREE DETERGENT HAVING A REDUCED TENDENCY TOWARDS INCRUSTATION

This application is a continuation of application Ser. No. 07/195,996, filed 5/19/88, now abandoned.

BACKGROUND OF THE INVENTION

1. Field of the Invention

This invention relates to a phosphate-free detergent composition having a reduced tendency towards fabric incrustation, and more particularly, to such a composition containing a combination of an aminoalkane polyphosphonate, a polymeric carboxylic acid, and a hydroxyalkane diphosphonate.

2. Discussion of Related Art

Phosphate-free detergents containing finely crystalline aluminosilicates as a phosphate substitute, sodium carbonate or sodium silicates as washing alkali, and polyanionic compounds from the class of aminoalkane polyphosphonic acids and homo- or copolymer polycarboxylic acids derived from acrylic acid, methacrylic, maleic acid and olefinically unsaturated, copolymerizable compounds are known. The phosphonic acids or salts thereof which are used preferably include ethylenediamine tetramethylene phosphonate, generally in the form of their sodium salts. Preferred polymeric carboxylic acids include copolymers of maleic acid with vinylmethylethers and, in particular, copolymers of maleic acid with acrylic acid in a ratio of 1:5 to 1:1 having a molecular weight of from 10,000 to 150,000. These polyacids are also normally present in the detergents as sodium salts. The quantities of aminoalkane phosphonates used are normally 0.1 to 1% by weight and the quantities of copolymers 3 to 6% by weight, based on the detergents. However, the complexing and precipitation-retarding properties (so-called threshold effect) of these additives are generally not good enough to limit the formation of fiber incrustations to the required extent because it has been found that the incrustations increase considerably when the fabrics are repeatedly washed with hard water, and can ultimately assume undesirable proportions. This increase in the incrustations is reflected in increasing hardening and discoloration (graying) of the fabric and may be quantitatively evaluated by determination of the fabric ash.

Accordingly, there exists the problem of reducing this tendency to form such incrustations.

DESCRIPTION OF THE INVENTION

Other than in the operating examples, or where otherwise indicated, all numbers expressing quantities of ingredients or reaction conditions used herein are to be understood as modified in all instances by the term "about".

The present invention, which solves this problem, relates to as detergent composition comprising:

(a) from 5 to 35% by weight of at least one water-soluble surfactant selected from the group consisting of an anionic and a nonionic compound, (b) from 10 to 40% by weight of a finely crystalline synthetic zeolite NaA, (c) from 4 to 20% by weight of a washing alkali selected from the group consisting of an alkali metal silicate and carbonate, (d) from 0.1 to 5% by weight, based on free acid, of at least one of the following compounds in the form of its alkali metal salt;

(d1) an aminoalkane polyphosphonic acid, (d2) a linear polymer or copolymer of acrylic acid or methacrylic acid and maleic acid, (e) from 5 to 80% by weight of other detergent constituents, characterized in that the detergent composition contains (f) from 0.5 to 1% by weight, based on free acid, of 1-hydroxyethane-1,1-diphosphonate in the form of its alkali metal salt, with the proviso that the ratio by weight of the component (d1):(f) is from 3:1 to 1:6 and that of component (d2):(f) is from 40:1 to 2:1, all weights being based on the weight of the detergent composition.

By phosphate-free is meant a detergent which contains less than 0.1% inorganically bound phosphorus.

The crucial feature of the invention is the joint use of the aminoalkane polyphosphonate or polymeric carboxylic acid or mixtures thereof mentioned under (d) with the hydroxyalkane diphosphonate mentioned under (f). Although the use of hydroxyalkane phosphonate (component f) in a detergent and cleaning preparation has been known for some time, this compound has not been used in modern phosphate-free detergents since the discovery of the aminoalkane phosphonates (d1) and the polymers according to (d2) because the hydroxyalkane phosphonate is known to have a very much lower sequestering power than the aminoalkane phosphonates according to (d1) and, in addition, has virtually no threshold properties comparable with the polymers according to (d2). Accordingly, it was extremely surprising to find that the joint use of the phosphonates (d1) and (f) provides for a considerably improved incrustation-inhibiting effect in relation to the sole use of only one of the two phosphonate types. The same applies to the joint use of the polymers according to (d2) and the component (f). The synergistic effect of the combination consisting of all three components is particularly pronounced.

Preferred salts of aminoalkane phophonic acids for component (d1) are ethylenediamine tetramethylene phosphonate (EDTMP), diethylenetriamine pentamethylene phosphonate (DTPMP) and higher homologs thereof. They are preferably used in the form of their neutralized sodium salts, for example as the hexasodium salt of EDTMP or as the hepta- or octa-sodium salt of DTPMP. They are present in the detergent composition in a quantity, expressed as free acid, of preferably from 0.1 to 1% by weight, and more preferably from 0.1 to 0.5% by weight, based on the weight of the composition.

Suitable (co)polymeric polycarboxylates (component d2) include polyacrylates, polymethacrylates and, in particular, copolymers of acrylic acid with maleic acid, preferably those containing 50% to 90% by weight of acrylic acid and 50% to 10% by weight of maleic acid. The molecular weight of the homopolymers is generally between 1000 and 100,000 and that of the copolymers between 2000 and 200,000 and preferably betwen 50,000 and 120,000, based on the free acid. A particularly preferred acrylic acid/maleic acid copolymer has a molecular weight of from 50,000 to 100,000.

Suitable, albeit less preferred, compounds of this class include copolymers of acrylic acid or methacrylic acid with vinyl ethers, such as vinylmethylether, in which the acid makes up at least 50%. It is also possible to use polyacetal carboxylic acids of the type described, for example, in U.S. Pat. Nos. 4,144,226 and 4,146,495 and obtained by polymerization of esters of glycolic acid, introduction of stable terminal groups and hydrolysis to the sodium or potassium salts. Polymeric acids obtained by polymerization of acrolein and Canizzaro disproportionation of the polymer with strong alkalis are also suitable. The consist essentially of acrylic acid units and vinyl alcohol units or acrolein units.

The (co)polymeric polycarboxylic acid content of the detergent composition, based on free acid (component d2), is preferably 0.5 to 5% by weight and more preferably 1 to 4% by weight.

The detergent composition may contain components (d1) and (d2) either individually or even together, preferably together. Where components (d1) and (d2) are present together, the mixing ratio of (d1) to (d2) is, for example, from 1:1 to 1:30 and preferably from 1:5 to 1:20, by weight.

The 1-hydroxyethane-1,1-diphosphonate (component f) is also preferably present in the form of the sodium salt. The disodium salt shows a neutral reaction and the tetrasodium salt an alkaline reaction (pH 9). It is present in a quantity, based on acid, of from 0.05 to 1% by weight, preferably from 0.1 to 0.7% by weight and more preferably from 0.1 to 0.5% by weight. The ratio by weight of (d1) to (f) is from 3:1 to 1:6 and preferably from 2:1 to 1:4, while the ratio by weight of (d2) to (f) is from 40:1 to 2:1 and preferably from 20:1 to 4:1.

The detergent composition according to the invention contains anionic or nonionic surfactants as further constituents (component a). These include soaps, anionic surfactants of the sulfonate and sulfate type and also nonionic compounds, for example, from the class of polyglycol ether derivatives. The detergent composition contains from 5 to 35% by weight and preferably from 8 to 20% by weight of component (a), based on the weight of the detergent composition.

Suitable soaps include those derived from natural or synthetic, saturated or monounsaturated $C_{12}$–$C_{22}$ fatty acids. Soap mixtures derived from natural fatty acids, for example coconut oil, palm kernel oil or tallow fatty acids, are particularly suitable. Preferred soap mixtures are those of which 50 to 100% by weight consists of saturated $C_{12}$–$C_{18}$ fatty acid soaps and 0 to 50% by weight of oleic acid soap.

Suitable surfactants of the sulfonate type include linear alkylbenzenesulfonates ($C_9$–$C_{13}$ alkyl) and olefin sulfonates, i.e. mixtures of alkene- and hydroxyalkanesulfonates and also disulfonates of the type obtained, for example from $C_{12}$–$C_{18}$ monoolefins containing a terminal or internal double bond by sulfonation with gaseous sulfur trioxide and subsequent alkaline hydrolysis of the sulfonation products. Other suitable surfactants of the sulfonate type include alkanesulfonates of the type obtainable from $C_{12}$–$C_{18}$ alkanes by sulfochlorination or sulfoxidation and subsequent hydrolysis or neutralization and also α-sulfofatty acids and esters thereof, for example the α-sulfonated hydrogenated coconut oil, palm kernel oil or tallow fatty acids and their methyl or ethyl esters and mixtures thereof.

Suitable surfactants of the sulfate type include the sulfuric acid monoesters of primary alcohols of natural and synthetic origin, i.e. of fatty alcohols such as, for example, coconut fatty alcohols, tallow fatty alcohols, oleyl alcohol, lauryl, myristyl, palmityl or stearyl alcohol, or the $C_{10}$–$C_{18}$ oxoalcohols and also the sulfuric acid esters of secondary alcohols of the same chain length. The sulfuric acid monoesters of aliphatic primary alcohols ethoxylated with 1 to 6 moles of ethylene oxide and ethoxylated secondary alcohols or alkyl phenols are also suitable. Sulfatized fatty acid alkanolamides and sulfatized fatty acid monoglycerides are also suitable.

Preference is attributed to surfactants containing sulfonate groups and, among these, to alkylbenzenesulfonates, α-sulfofatty acid ester salts and α-sulfofatty acid ester di-salts. The anionic surfactants are normally present in the form of their sodium salts. The quantity in which they are present, based on the detergent compositions, is generally from 2 to 15% by weight, and preferably from 5 to 12% by weight.

Suitable nonionic surfactants include adducts of 2 to 20, and preferably 3 to 15, moles of ethylene oxide with 1 mole of a compound essentially containing 10 to 20 carbon atoms selected from the group consisting of alcohols and alkylphenols. Of particular importance are the adducts of 7 to 15 moles of ethylene oxide with primary alcohols, for example with coconut or tallow fatty alcohols, with oleyl alcohol, with oxoalcohols, or with secondary alcohols containing 8 to 18 and preferably 12 to 18 carbon atoms and also with mono- or dialkylphenols containing 6 to 14 carbon atoms in the alkyl radicals. In addition to these water-soluble nonionics, however, water-insoluble or substantially water-insoluble polyglycol ethers containing 2 to 6 ethylene glycol ether groups in the molecule may also be used, particularly where they are used together with water-soluble nonionic or anionic surfactants. Other suitable nonionic surfactants include alkyl glycosides and alkyl polyglycosides wherein the alkyl group contains 8 to 18 and preferably 10 to 16 carbon atoms. The quantity of nonionic surfactant or mixture of nonionic surfactants in the detergent composition is preferably from 3 to 10% by weight and more preferably from 3 to 7% by weight, based on the weight of the detergent composition.

Component (b) consists of finely crystalline, synthetic water-containing zeolites of the NaA type which have a calcium binding power of 100 to 200 mg CaO/g (as defined in German Patent 22 24 837). Their particle size is normally in the range from 1 to 10 μm. The quantity of component (b) is from 10 to 40% by weight and preferably from 12 to 25% by weight, based on the weight of the detergent composition.

Suitable washing alkalis (component c) include alkali metal silicates, particularly sodium silicates having the composition $Na_2O:SiO_2 = 1:1$ to 1:3.5 and preferably 1:2 to 1:3.35. Their quantity in the detergent composition may be from 1 to 8% by weight and is preferably from 2 to 5% by weight, based on the weight of the detergent composition. The sodium silicate improves the particle stability and particle structure of the powder-form or granular detergent composition and has a favorable effect on its dispensing and dissolving behavior in automatic washing machines. It also has an anticorrosive effect and improves detergency. Although it was known that relatively large contents, i.e. more than 2 to 3% by weight, of alkali metal silicates in zeolite-containing detergent compositions lead to irreversible agglomeration of the zeolite particles which are deposited on the fabrics and can increase their ash value and impair their appearance, it has surprisingly been found that this adverse effect is largely eliminated by the combination of components (d) and (f) according to the invention and that the content of sodium silicate, desirable for the reasons mentioned, can be increased without any of the above-mentioned disadvantages.

The washing alkali (component c) may also be sodium carbonate whose content in the detergent composition may be up to 15% by weight and is preferably from 2 to 12% by weight and more preferably from 5 to 10% by weight. The total quantity of sodium silicate and sodium carbonate comprises 4 to 20% by weight, preferably from 5 to 15% by weight and more preferably from 7 to 12% by weight, based on the weight of the detergent composition.

The other detergent constituents (component e), of which the content in the detergent composition is from 5 to 80% by weight and preferably from 10 to 50% by weight, based on the weight of the detergent composition, include redeposition inhibitors (soil suspending agents), bleaches, bleach activators, optical brighteners, foam inhibitors, enzymes, fabric softeners, dyes and perfumes and also neutral salts and water.

The detergent and cleaning preparations may contain as part of this component (c) redeposition inhibitors which keep the soil detached from the fibers suspended in the wash liquor and thus prevent its redeposition. Suitable redeposition inhibitors include water-soluble, generally organic, colloids such as, for example, the water-soluble salts of polymeric carboxylic acids, glue, gelatin, salts of ether carboxylic acids or ether sulfonic acids of starch or cellulose, or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches, etc. Polyvinyl pyrrolidone may also be used. Carboxymethyl cellulose (Na salt), methyl cellulose and mixtures thereof are preferably used. The quantity of these compounds in the detergent composition is generally from 0.2 to 2% by weight and preferably from 0.5 to 1.5% by weight, based on the weight of the detergent composition.

Of the compounds yielding $H_2O_2$ in water which are used as bleaches, sodium perborate tetrahydrate ($NaBO_2.H_2O_2.3H_2O$) and the monohydrate ($NaBO_2.H_2O_2$) are of particular importance. However, it is also possible to use other $H_2O_2$-yielding borates, for example perborax $Na_2B_4O_7.4H_2O_2$. These compounds may be completely or partly replaced by other active oxygen donors, more especially peroxyhydrates, such as peroxycarbonates ($Na_2CO_3.1.5H_2O_2$), peroxypyrophosphates, citrate perhydrates, urea-$H_2O_2$ or melamine-$H_2O_2$ compounds, and also by $H_2O_2$-yielding peracidic salts or peracids, such as perbenzoates, peroxyphthalates, diperazelaic acid or diperdodecanedioic acid.

To obtain an improved bleaching effect at washing temperatures below 80° C. and more especially in the range from 40° to 60° C., bleach activators may be incorporated in the detergent composition. Examples of bleach activators include N-acyl and O-acyl compounds which form organic peracids with $H_2O_2$, preferably N,N$^1$-tetraacylated diamines, such as N,N,N$^1$,N$^1$-tetraacetyl ethylenediamine, also carboxylic anhydrides, such as benzoic anhydride and phthalic anhydride, and esters of polyols, such as glucose pentaacetate.

The detergent composition may contain in particular derivatives of diaminostilbene disulfonic acid and alkali metal salts thereof as optical brighteners for cotton. Suitable constituents of this type include, for example, salts of 4,4$^1$-bis-(2-anilino-4-morpholino-1,3,5-triazin-6-ylamino)-stilbene-2,2$^1$-disulfonic acid or compounds of similar structure which contain a diethanolamino group, a methylamino group or a 2-methoxyethylamino group instead of the morpholino group. Suitable brighteners for polyamide fibers include those of the 1,3-diaryl-2-pyrazoline type, for example the compound 1-(p-sulfamoylphenyl)-3-(p-chlorophenyl)-2-pyrazoline. Brighteners of the substituted 4,4$^1$-distyryldiphenyl type, for example the compound 4,4$^1$-bis-(4-chloro-3-sulfostyryl)-diphenyl, may also be present. Mixtures of the above-mentioned brighteners may also be used.

Suitable enzymes include those from the class of proteases, lipases and amylases and mixtures thereof. Enzymatic agents obtained from bacterial strains or fungi, such as *Bacillus subtilis, Bacillus licheniformis* and *Streptomyces griseus* are particularly suitable. The enzymes may be adsorbed onto carriers and/or embedded in shell-forming substances to protect them against premature decomposition.

Suitable foam inhibitors include organopolysiloxanes and mixtures thereof with microfine, optionally silanized silica, paraffins, waxes, microcrystalline waxes and mixtures thereof with silanized silica. Bis-acylamides derived from $C_{12}$–$C_{20}$ fatty acids and $C_2$–$C_6$ diamines and from $C_{12}$–$C_{20}$ alkylamines and $C_2$–$C_6$ dicarboxylic acids may also be used. It is also of advantage to use mixtures of different foam inhibitors, for example mixtures of silicones and paraffins or waxes or of bisacylamides and paraffins or waxes. The foam inhibitors are preferably bound to a granular water-soluble or water-dispersible carrier material.

Suitable fabric-softening additives include layer silicates from the class of bentonites and smectites, for example those according to German Patent 23 34 899 and European Patent 26 529. Also suitable are synthetic finely-divided layer silicates having a smectite like crystal phase and a reduced swelling power corresponding to the following formula $$MgO(M_2O)_a(Al_2O_3)_b(SiO_2)_c(H_2O)_n$$

wherein M is sodium, optionally sodium together with lithium, with the proviso that the molar ratio of Na to Li is at least 2, a=0.05 to 0.4, b=0 to 0.3, c=1.2 to 2 and n=0.3 to 3, $(H_2O)_n$ representing the water bound in the crystal phase. Other suitable fabric softeners include synthetic layer silicates which, after suspension in water (16° Gh, room temperature), have a swelling power, determined as the quotient of the sediment volume ($V_s$/total volume (V) after treatment with excess soda solution, careful washing and 20 hours after suspension in 9 parts by weight water/1 part by weight layer silicate, of $V_s/V$=less than 0.6 and, more especially, less than 0.4; and synthetic layer silicates which have a mixed crystal structure comprising structure-determining saponite- and/or hectorite-like crystal phases which are irregularly permeated by crystalline alkali metal polysilicate. Layer silicates such as these are described in detail in German Patent 35 26 405. The content of layer silicates may be, for example, from 5 to 20% by weight, based on the weight of the detergent composition.

The detergent composition may be produced in a conventional manner, i.e. by spray drying of the constituents which are stable under spray-drying conditions and subsequent incorporation of the heat-sensitive components, such as bleaches, enzymes, perfumes and foam inhibitors. Other suitable processes include granulation of the consituents, in which case water, salt solutions, polymer solutions and/or nonionic surfactants may be used as the granulation liquid. Of particular value is the discovery that, despite the presence of zeolites, the alkali metal silicate content may be increased to more than 2.5 to 3% by weight without any danger of increased ash formation, so that the particle strength and pourability of the final granular powder may be increased because the addition of HEDP (component f) counteracts ash formation.

EXAMPLES

Granular detergent compositions having the formulations shown below were prepared and tested. The constituents shown in 1st to 9th place and most of the sodium sulfate were mixed to form an aqueous slurry and spray-dried in a test tower. The perborate, the bleach activator and granulates were subsequently incorporated in the spray-dried product. The quantities are in % by weight.

7.0 Na dodecyl benzenesulfonate
1.5 Na tallow soap
6.5 $C_{12}$–$C_{18}$ fatty alcohol+3–5 moles ethylene oxide
25.0 zeolite NaA
10.0 sodium carbonate
2.5 Na silicate ($Na_2O:SiO_2=1:3.3$)
0.8 cellulose ether
0.2 optical brightener
5.0 phosphonate/copolymer/Na sulfate mixture
25.0 Na perborate tetrahydrate
2.0 tetraacetyl ethylenediamine
0.5 enzyme granulate
0.5 silicone foam inhibitor granulate
balance sodium sulfate, water Testing was carried out under near-practical conditions in domestic washing machines. To this end, the machines were loaded with 3.5 kg of normally soiled domestic washing (bed linen, table linen, underwear) and 0.5 kg of test fabrics in the form of strips of standardized cotton fabric (Wascheforschungsanstalt Krefeld), nettle, knitted fabric (cotton tricot) and terry cloth. Washing conditions: tapwater at 16° C. (equivalent to 160 g CaO/liter), prewash cycle 5 g/l at 15° to 30° C., main wash cycle 7.5 g/l at 25° to 92° C. (heating times 15 mins., 15 mins. at 92° C.), wash liquor ratio (kg washing per liter wash liquor) in main wash cycle 1:4, 5 rinses with tapwater, spin-drying and tumbler drying. After 50 wash cycles, the ash content of the fabric samples was quantitatively determined.

In Table 1 below, EDTMP stands for the hexasodium salt of ethylenediamine tetramethylenephosphonic acid (1 g salt corresponding to 0.77 g free acid), HEDP for the tetrasodium salt of 1-hydroxy-1,1-ethane diphosphonic acid (1 g salt corresponding to 0.7 g free acid), AMC for the sodium salt of a copolymer of acrylic acid and maleic acid in a molar ratio of 4:1, molecular weight 70,000, pH value 9 (partially neutralized, 1 g salt corresponding to approx. 0.82 g free acid). The quantities of the salts used are shown in % by weight (the amount expressed as free acid is shown beneath in brackets). The balance to 5% by weight is made up by sodium sulfate.

In the absence of the 3 components (d1), (d2) and (f), the average value of the ash content determined among all the fabric samples was 9.2% by weight after 50 washes. The result is shown as the percentage change in the ash content (+=increase, −=decrease) in relation to that standard.

The lowest ash values (greatest reduction in relation to the standard) are obtained in accordance with Examples 1 to 3 by the combination of components (d1), (d2) and (f). However, the 2-component combinations of Examples 5 to 9 also lead to a distinct ash reduction compared with the combinations described in the following comparison tests.

The following known complexing agents
NTA (trisodium salt of nitrilotriacetic acid),
EDTA (tetrasodium salt of ethylenediamine tetraacetic acid) and
DTPMP (heptasodium salt of diethylenetriamine pentamethylene phosphonic acid)
were additionally investigated in the comparison tests.

The quantities in Table 2 relate to the salts. The balance to 5% consists of sodium sulfate. The test S represents the standard.

The results show that even small additions of HEDP to the detergent composition lead to a considerable reduction in fabric incrustation. A corresponding increase in the proportions of aminopolyphosphonic acids (EDTMP and DTPMP) or of copolymers does not produce a comparable reduction in the ash values. Replacement by other complexing agents (EDTA, NTA) has no beneficial effect or even increases incrustation.

EXAMPLE 10

In the detergent composition according to test A (Table 2), the sodium silicate content was increased in increments to 3.7, 5 and 6% by weight at the expense of the sodium sulfate content, the ash values increasing by 35%, 37% and 38% in relation to the standard. Providing 0.4% HEDP (Na salt) was added, there was no increase in the ash values. A corresponding increase in the EDTMP content did not produce a comparable improvement, i.e. the ash values increased by 22%.

TABLE 1

| Example | EDTMP (%) | HEDP (%) | AMC (%) | Ash (% change) |
|---|---|---|---|---|
| 1 | 0.22 (0.17) | 0.22 (0.154) | 4.0 (3.2) | −55 |
| 2 | 0.22 (0.17) | 0.4 (0.28) | 4.0 (3.2) | −61 |
| 3 | 0.22 (0.17) | 0.4 (0.28) | 3.0 (2.7) | −65 |
| 5 | 0.20 (0.154) | 0.6 (0.42) | — — | −50 |
| 6 | 0.6 (0.46) | 0.20 | — | −48 (0.14) |
| 7 | — | 0.22 (0.154) | 4.0 (3.2) | −44 |
| 8 | — | 0.4 (0.28) | 4.0 (3.2) | −53 |
| 9 | — | 0.4 (0.28) | 5.0 (4.0) | −49 |

TABLE 2

| Test | EDTMP % | AMC % | DETMP % | NTA % | EDTA % | Ash (% change) |
|---|---|---|---|---|---|---|
| S | 0.22 | — | — | — | — | — |
| A | 0.22 | 4.0 | — | — | — | −34 |
| B | 0.45 | 4.0 | — | — | — | −41 |
| C | 0.60 | 4.0 | — | — | — | −44 |
| D | 0.22 | 5.0 | — | — | — | −28 |
| E | — | 5.0 | — | — | — | +15 |
| F | — | 4.0 | 0.6 | — | — | −3 |
| G | — | 4.0 | — | 1.0 | — | +20 |

TABLE 2-continued

| Test | EDTMP % | AMC % | DETMP % | NTA % | EDTA % | Ash (% change) |
|---|---|---|---|---|---|---|
| H | 0.22 | — | — | — | 0.20 | ±0 |

We claim:

1. A detergent composition consisting of:

(a) from about 5 to about 35% by weight of at least one water-soluble surfactant selected from the group consisting of an anionic and a nonionic compound, (b) from about 10 to about 40% by weight of a finely crystalline synthetic zeolite NaA, (c) from about 4 to about 20% by weight of a washing alkali selected from the group consisting of an alkali metal silicate and carbonate, (d) the following compounds in the form of their alkali metal salt; based on free acid, (d1) from about 0.1 to about 1% by weight of an aminoalkane polyphosphonic acid, (d2) from about 0.5 to about 5% by weight of a linear polymer or copolymer of acrylic acid or methacrylic acid and maleic acid, and (e) from about 0.5 to about 1% by weight, based on free acid, of 1-hydroxyethane-1,1-diphosphonate in the form of its alkali metal salt, with the proviso that the ratio by weight of component (d1):(e) is from about 40:1 to about 2:1, all weights being based on the weight of said detergent composition.

2. A detergent composition as in claim 1 wherein said component (d1) is selected from the group consisting of ethylenediamine tetramethylene phosphonate, diethylenetriamine pentamethylene phosphonate, and higher homologs thereof.

3. A detergent composition as in claim 1 wherein said component (d2) is selected from the group consisting of polyacrylate, polymethacrylate, and a copolymer of acrylic acid with maleic acid.

4. A detergent composition as in claim 3 wherein said copolymer comprises from about 50 to about 90% by weight of acrylic acid and from about 50 to about 10% by weight of maleic acid and has a molecular weight of between about 2,000 and about 200,000.

5. A detergent composition as in claim 1 containing component (d1) and component (d2) in a weight ratio of from about 1:1 to about 1:30.

6. A detergent composition as in claim 1 containing component (d1) and component (e) in a weight ratio of from about 2:1 to about 1:4.

7. A detergent composition as in claim 1 containing component (d2) and component (e) in a weight ratio of from about 20:1 to about 4:1.

8. A detergent composition as in claim 1 wherein components (d1), (d2) and (e) are present in the form of the sodium salts.

9. A detergent composition as in claim 1 wherein said anionic compound is selected from a sulfonate and a sulfate.

10. A detergent composition as in claim 1 wherein said nonionic compound is a polyglycol ether derivative.

* * * * *

UNITED STATES PATENT AND TRADEMARK OFFICE

CERTIFICATE OF CORRECTION

PATENT NO. : 4,919,845

DATED : April 24, 1990

INVENTOR(S) : Guenther Vogt, et al.

It is certified that error appears in the above-identified patent and that said Letters Patent is hereby corrected as shown below:

In Claim 1, Column 9, line 29, after "about" insert --3 : 1 to about 1 : 6 and that of component (d2) : (e) is--.

Signed and Sealed this

Eleventh Day of June, 1991

*Attest:*

HARRY F. MANBECK, JR.

*Attesting Officer*

*Commissioner of Patents and Trademarks*